United States Patent [19]

Brieu

[11] 4,406,740

[45] Sep. 27, 1983

[54] APPARATUS FOR EFFECTING THE FINE-ADJUSTMENT OF THE LIP OF A HEAD-BOX OF A PAPER MAKING MACHINE

[75] Inventor: Francois M. P. Brieu, Saint-Cloud, France

[73] Assignee: Chleq Frote et Cie, Paris, France

[21] Appl. No.: 292,420

[22] Filed: Aug. 13, 1981

[30] Foreign Application Priority Data

Aug. 18, 1980 [FR] France ..... 80 18048

[51] Int. Cl.[3] ..... D21F 1/06

[52] U.S. Cl. ..... 162/259; 162/347

[58] Field of Search ..... 162/259, 344, 347; 425/141, 143, 144, 466

[56] References Cited

U.S. PATENT DOCUMENTS

| | | | |
|---|---|---|---|
| 2,993,538 | 7/1961 | Mustonen | 162/347 |
| 3,261,893 | 7/1966 | George et al. | 162/347 |
| 3,575,799 | 4/1971 | Gedener et al. | 162/347 |
| 3,914,156 | 10/1975 | Batcher | 162/344 |

*Primary Examiner*—Steve Alvo

[57] ABSTRACT

A method and apparatus for adjustment of a movable lip of a head-box of a paper-making machine. Tubes mounted on screw-jacks each contain an electrical heating resistor which enables them to increase in length by thermal expansion as a function of the current passed to the electrical resistor. This current is regulated by a computer as a function of continuous measurements of the mass of the sheet of paper produced by the machine.

13 Claims, 9 Drawing Figures

92
90
84
88
94

110
112
104
106
108

112
120
110
118
114
116
106
30
90
86
84

10
88
94
96
100
102
98
14

48
78
80
82
26
10
76

APPARATUS FOR EFFECTING THE FINE-ADJUSTMENT OF THE LIP OF A HEAD-BOX OF A PAPER MAKING MACHINE

BACKGROUND OF THE INVENTION

The present invention relates to apparatus for effecting the fine-adjustment of the position of a scraper blade and particularly of a lip of the head-box of a paper-making or cardboard-making machine. It also relates to a method of adjusting a property of material produced on a continuous basis on a machine having a scraper blade, for example a machine for making paper or cardboard, by effecting fine adjustment of the position of the scraper blade.

The description that follows relates to the fine adjustment of the position of the lip of a head-box or starting box of a paper-making or cardboard-making machine, but it should be pointed out that it has other applications in fields in which the adjustment of a scraper blade is called for.

The head-box of a paper-making machine converts the flow of fibrous suspension, forming the paper slurry, from a cylindrical stream into a layer corresponding to the width of the sheet to be formed. This head-box takes the form of a reservoir of variable shape, the front face of which has, towards the bottom, a slot provided with lips, between which the liquid slurry is projected onto a production wire. The purpose of the head-box is to ensure a constant delivery and to adjust the fibrous suspension over the entire width of the machine, which may be as much as nine meters in the case of modern installations.

The layer containing fibres in suspension as well as mineral filler is forced under a pressure of between approximately 0.03 and 2 bars between the lips in modern high-speed machines. The evenness of the rate of discharge of the layer containing fibres in suspension and the uniformity in thickness, together with the uniformity of the concentration determine the uniformity of the weight per unit area of the manufactured product. In modern paper-making machines, flow takes place between two metallic lips, one of which is fixed whereas the other is movable as a whole so that it adjusts the thickness. Furthermore, the movable lip, which is usually the upper lip, is deformable lengthwise under the action of rods controlled by manually-operated screw-jacks. A modern head-box comprises several dozens of such manually-operated screw-jacks.

The correction of the thickness of the layer of material containing fibres in suspension as it passes the lip, as a function of the changes in weight per unit of area of the product obtained at the end of the machine, is not very conveniently carried out with the aid of such manually-operated screw-jacks, the adjustment of which is a delicate matter and which gives good results only on a trail-and-error basis.

To eliminate this disadvantage, head-boxes have been designed wherein the manually-operated regulating screw-jacks are each controlled by a motor-reducer unit which is itself controlled in dependence upon continuous measurements of mass, by way of a computer which receives the results of the measurements of mass and calculates the corrections to be made by acting on the machine elements and particularly on the movable lip.

These control systems using motor-reducers are not sufficiently satisfactory. In fact, relatively great mechanical back-lash always occurs, and precision in adjustment is not very great. However, the greatest drawback is the very high cost of these mechanisms, since the head-box of a modern machine may comprise up to sixty or more of them.

U.S. Pat. No. 2,779,253 describes a purely mechanical means for adjusting the movable lip of a head-box of a paper-making machine. According to that Patent, adjustment is carried out on a purely mechanical basis with the aid of screw-jacks, and variations are detected by means of a mechanical comparator. French Pat. No. 1,192,516 describes apparatus for adjusting the orifice through which the paper slurry passes from a head-box, the adjustment being achieved by inflating and deflating rubber-bellows devices which form the edges of the lips. Thus, the device is pneumatically or hydraulically operated.

On the other hand, U.S. Pat. Nos. 2,938,231 and 3,940,221 describe dies for the extrusion of plastics material wherein the position of part of a first side of the die is adjusted with the aid of a heat-expansible device; in particular, the above-mentioned U.S. Pat. No. 3,940,221 describes a guide for the extrusion of plastics material that comprises a block, one part of which, designed to delimit the outlet orifice, is separated from the body of the block by a part of reduced thickness so that it acquires a certain resilience. A heat-expansible rod applies varying degrees of thrust to this flexible end so as to determine its position in a precise manner.

Dies for extruding plastics material are devices that are totally different from the lips of the head-boxes of paper-making machines. In fact, the plastics material passing through an extursion die is moved under a very high pressure. The die must comprise, at least over a certain distance, a duct having substantially parallel walls so that they continually guide the material which, in effect, is aligned when it flows into the die orifice. In contrast to this, the lip of a head-box of a paper-machine is formed by a scraper blade which is set, relative to the surface of the formed layer, at a relatively large angle, generally at least 30° and sometimes as much as 90°. A lip of this kind must not, in any event, cause orientation of the fibres suspended in the material that passes below it. In fact, such orientation of the fibres would be disastrous in the finished paper (producing a direction of preferential tearing). It is therefore essential not only that the lip be considerably inclined in relation to the formed layer of product material, but also that the pressure on the material containing fibres in suspension be slight.

It is therefore obvious that the lip of a head-box of a paper-making machine is a device that is totally different from a die for extruding plastics material.

In view of the fact that there are at present in existence means for continuously measuring mass and that these means can be connected to computers which are able to recognise the need for corrections and to calculate their amounts, it is very desirable to provide simple and inexpensive devices for continuously effecting fine adjustment of the position of the moving lip of a head-box of a paper-making machine at different points along this lip.

SUMMARY OF THE INVENTION

The invention concerns such an apparatus having a positioning member, mounted between the frame of the machine and the lip, and a means for heating the positioning member so as to vary the length of this member and to ensure that the lip is held in the required position. This position is determined from the results of the continuous measurements, for example the measurement of mass, by means of a computer which makes it possible to control the heating means for a large number of positioning members positioned along the head-box. The positioning means is thus a stationary mechanism requiring no maintenance and no lubrication, and it is extremely reliable.

More precisely, the invention relates to a means for effecting fine-adjustment of the positioning, relative to a support, of an inclined blade for scraping a fluid on a surface by displacing the blade in a pre-determined direction, said means comprising:

a positioning member which co-operates at a first point with the support and at a second point with the scraper blade, a means for heating at least one part of the positioning member, which part lies between the two co-operation points, and a member for controlling the heating means in dependence upon the required position of the scraper blade in relation to the support.

Advantageously, the system also comprises a coarse-adjustment means, for example, a manually operated screw-jack designed to alter the distance between the two co-operation points. In an advantageous embodiment, the positioning member comprises at least one mounting part and a heat-expansible part intended to be heated, and the mounting part is cooled, in particular by convection or the circulalation of a cooling fluid.

In a further embodiment, the mounting part for the positioning member is arranged parallel with the heat-expansible part and on the same side as the latter of the point at which they are connected, and an additional heating means is provided for heating the mounting part and is located between the points at which it is connected to the heat-expansible part and to the support. In this case, thermal-insulation means is advantageously placed between the mounting part and the heat-expasible part.

The positioning member advantageously also comprises a force-transmission element designed to bring about displacement of the lip in the said pre-determined direction when the heat-expansible part becomes longer or shorter in one or other direction. Furthermore, this force-transmission element or some other element may constitute a multiplier element which causes a displacement of the scraper blade that is substantially equal to a multiple of the distance travelled by that end of the heat-expansible part that is disposed opposite the mounting part.

It is advantageous that the means for heating the heat-expansible part and, where necessary, the means for heating the mounting part are of a type selected from the following: an element producing heat by the Joule effect and in thermal contact with the positioning member; means heating the positioning member directly by the Joule effect by the circulation of electric current therein; flame-heating means; and means for applying heat by contact with a heat-carrying fluid.

In an advantageous embodiment, the heat-expansible part is flexible, and the system also comprises a spring designed to push the scraper blade in a direction substantially parallel with said pre-determined direction.

A particularly advantageous application of the invention is of course that in which the support is a part of a head-box of a paper-making machine, and the scraper blade is a lip for regulating the thickness of the layer of material containing fibres in suspension that is intended to form a paper.

The invention also concerns a method of adjusting a property of a material produced on a continuous basis in a machine, the latter being of a type which comprises a scraper blade that is movable relatively to a support and is connected at a first location to a positioning member which in turn is connected to a support at a second location, the position of the scraper blade relative to the support influencing said property of the continuously produced material; according to the invention, this method comprises:

the direct or indirect measurement of said property of the material and the generation of a signal representing this measurement;

the comparison of the measurement signal with a reference signal and the generation of a comparison signal; and regulation, as a function of the comparison signal, of the heating of at least one part of the positioning member between the two points at which it co-operates with the moving part and with the support.

In an advantageous embodiment wherein the positioning members may be differentially heated, that is to say, when use is made of a positioning member having a mounting part and a heat-expansible part loacted at the same side of the point of co-operation, the method comprises the regulation of the heat applied either to the heat-expansible part or to the mounting part depending upon the direction in which the lip has to be moved.

Other features and advantages of the invention will emerge more clearly from the following description which refers to the attached drawings.

BREIF DESCRIPTION OF THE DRAWINGS

DETAILED DESCRIPTION OF THE INVENTION

Figures 1, 2:
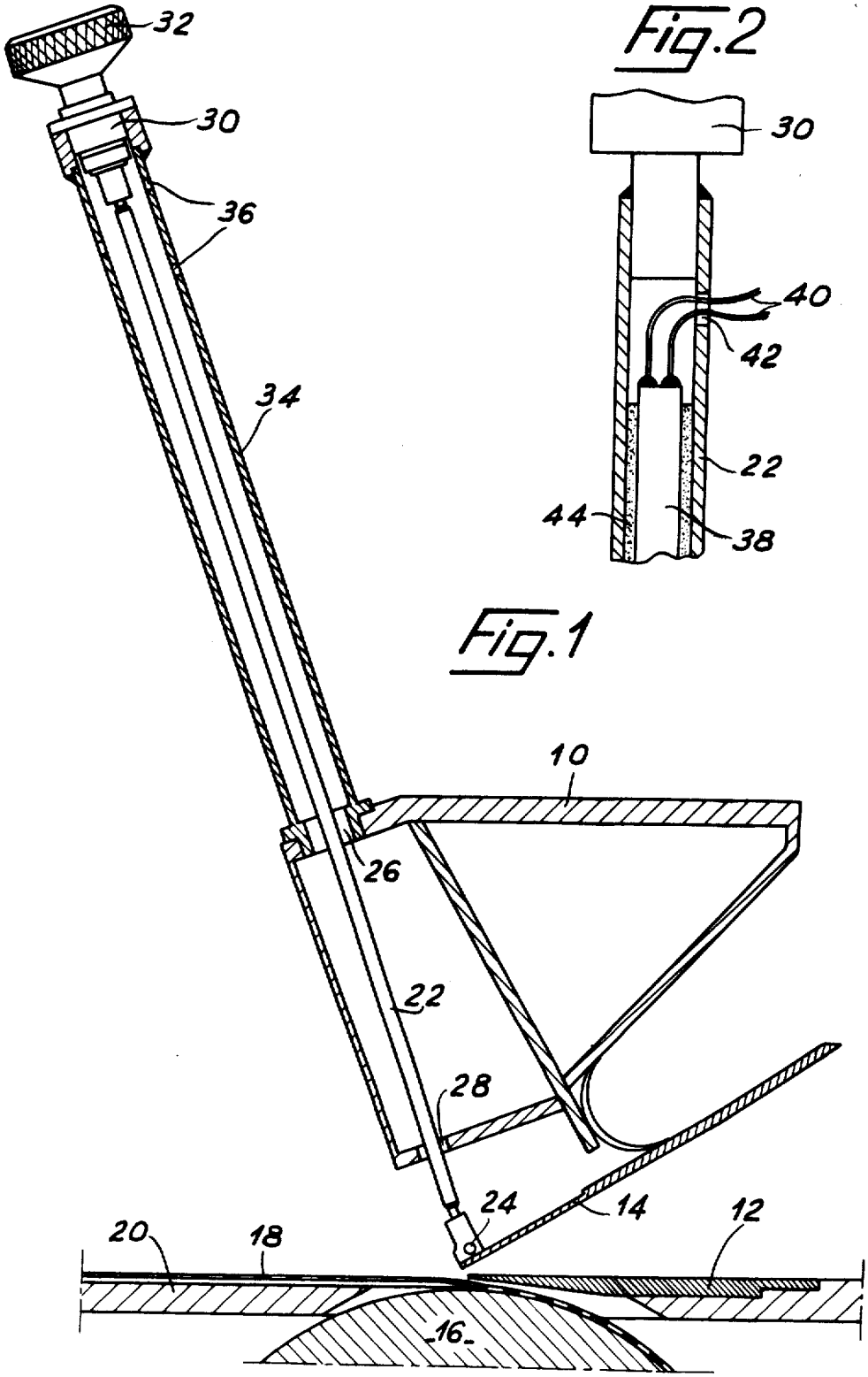
FIG. 1 shows diagrammatically a section through a portion of a head-box of a paper-making machine and illustrates a means, in accordance with the invention, for positioning the movable lip of the box.
FIG. 2 shows, on a larger scale than FIG. 1, a detailed section of a part of the positioning means of FIG. 1.

FIGS. 1 and 2 illustrate an example of the positioning means in accordance with the invention. FIG. 1 shows the mounting of the positioning means in a head-box of a known type; only a part of the box is illustrated and it has a frame 10. The layer of material containing fibres in suspension that is formed by the box passes between a substantially horizontal fixed lip 12 and a movable lip 14. The layer of material is formed on the breast roll 16 of a production wire comprising a porous screen or mesh formed of metal or plastic 18 mounted on forming board 20 just beyond the breast roll 16. That end of the movable lip 14 that is nearer the production bench is secured to a tube 22 by way of a hinge 24. The tube 22 passes through openings 26 and 28 in members of the frame 10 of the box. The other end of the tube 22 is secured to a screw-jack 30, which is manually operated by means of a knurled knob 32. The fixed part of the screw-jack is mounted on a support tube 34 secured to the frame. This tube 34 has small orifices 36 formed in its upper portion.

The positioning means in accordance with the invention comprises the tube 22, the screw-jack 30 and the tube 34.

FIG. 2 illustrates in greater detail the upper portion of the tube 22. The interior of the tube houses an electric heating element 38 having connecting wires 40 which pass through an opening 42 in the wall of the tube 22. Packing 44, consisting of a material having good thermal conductivity, is advantageously used for holding the heating element 38 in the tube 22. In one form of construction, the length of the resistor 38 introduced into the tube 22 is one meter. The tube 22 itself is made of brass, and when the resistor, the rating of which is 70 W and which is supplied with electricity at a voltage of 20 V, is operating at maximum power, the tube reaches a maximum temperature of 90° C. In these conditions, the change in length of the tube 22 between these two extreme temperatures is in the order of magnitude of 1.2 mm. Since the thickness of the layer of material with fibres in suspension that is formed on the production wire is generally between 5 and 40 mm, this adjustment range is quite satisfactory for correcting the variations observed during the course of manufacture when coarse adjustment has been carried out manually by operating the screw-jacks 30.

In a head-box of a modern machine, sixty or so positioning means of the type illustrated in FIG. 1 can be actuated simultaneously on the basis of signals transmitted by a computer.

Control of the heating elements for the various positioning means can be carried out using numerous known techniques, for example by varying the voltage applied, by varying the period during which a fixed voltage is applied, by varying the frequency of the impulses that are applied, or by any other method or combination of methods of control that are well known to the expert in the field.

In the form of construction shown in FIG. 1, it is obviously desirable that only the tube 22 should heat up and that the tube 34 should remain at ambient temperature. Since the heat released in the tube 22 must be discharged, the holes 36, formed in the upper portion of the tube 34, permit the circulation of a current of air which passes through the frame 10 and rises in the tube 34 which only acts as a support.

In view of the relatively great inertia of the tube 22 when it heats up, several minutes have to elapse before a fault is effectively corrected. Taking into account the speed of continuous measurement of the mass in the paper-making machines, a time-constant of this kind is quite satisfactory. If, however, it appears to be too great in certain applications, it could be reduced by the use of greater heating and of artificial cooling of the tube 22, for example, this tube may have fins which increase the rate at which it is cooled. In a modified arrangement, the tube 22 may be of double-walled type with a cooling liquid, for example water, circulating between the walls.

Upon start-up of a paper-making machine having a head-box equipped with positioning means in accordance with the invention, the movable lip is initially adjusted with the aid of the screw-jacks 30 so that its edge is parallel with the fixed lip. The production run of the machine then starts. A sheet profile is then established dependent upon the results of the measurement of weight per square meter that is carried out continuously at the end of the machine. Since the positioning means are initially cold, the portions of the sheets that are too heavy can be corrected by heating the positioning means that correspond to these thick areas so that they are elongated.

Figure 3:
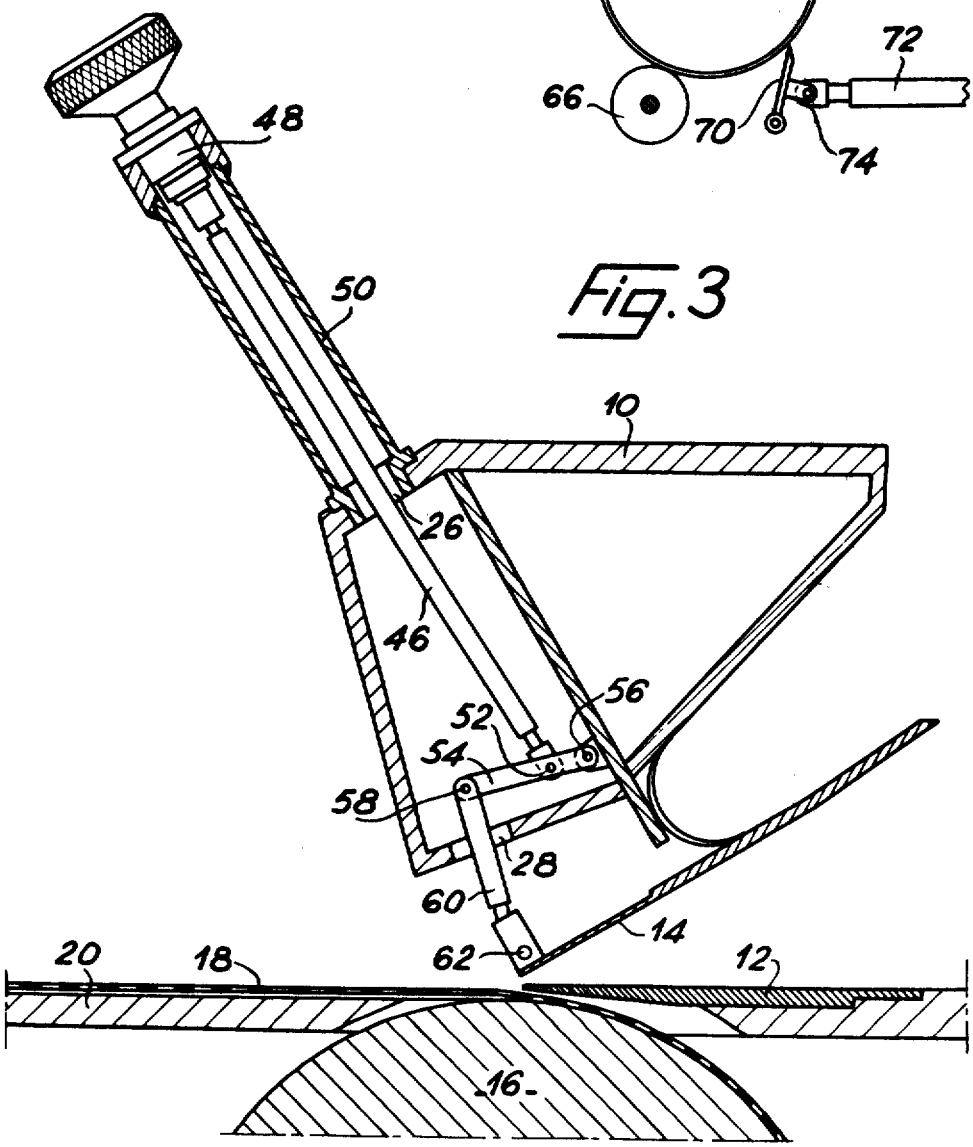
FIG. 3 is similar to FIG. 1 but illustrates a modified form of the positioning means in accordance with the invention.

FIG. 3 is similar to FIG. 1 and illustrates a modified form of the positioning means in accordance with the invention. In this modification, the length of the positioning means is less than that of the means shown in FIG. 1. In FIG. 3 reference numerals identical to those used in FIG. 1 designated similar elements. Thus, the frame 10 of a head-box, having a fixed lip 12 and a movable lip 14 and forming a layer of material containing fibres in suspension on the end cylinder 16 of a production wire, supports a positioning means which comprises a tube 46, similar to the tube 22 but considerably shorter, a screw-jack 48 which may be identical to the jack 30 in the FIG. 1 embodiment, and a support tube 50 similar to the tube 34.

In the FIG. 3 embodiment, the changes in length of the tube are not transmitted directly to the movable blade 14, but by way of a connecting rod 54. The latter is hinged at 52 to the end of the tube 46. One end of the connecting rod is hinged at 56 on the frame 10, whereas the other end is hinged at 58 on the rod 60 which is itself hinged at 62 to the movable lip 14. As shown in FIG. 3, the distance between the hinge 52 for the heat-expansible tube 46 and the hinge 56 on the frame 10 is much less than the distance separating the hinge 58 for the rod 60, which controls displacement of the lip 14, from the hinge 56. In this way, the displacement of the rod 46 is increased by means of the connecting rod 54. Since the force that has to be applied to the movable lip 14 by a positioning device is of the order of 200 N at most, the force applied by the tube 46 to the hinge 52 is only of the order of 600 N since the multiplication factor is only three. Such force can readily be applied by a tube of small diameter and wall-thickness.

The main advantage of the FIG. 3 embodiment over that shown in FIG. 1 lies in a considerable reduction of the total length of the positioning means. However, the FIG. 3 arrangement suffers from the disadvantage of the need for incorporating movable elements which can only reduce the reliability of the system, despite the fact that very simple and very robust mechanisms are used.

Figures 4, 5, 6, 7, 8:
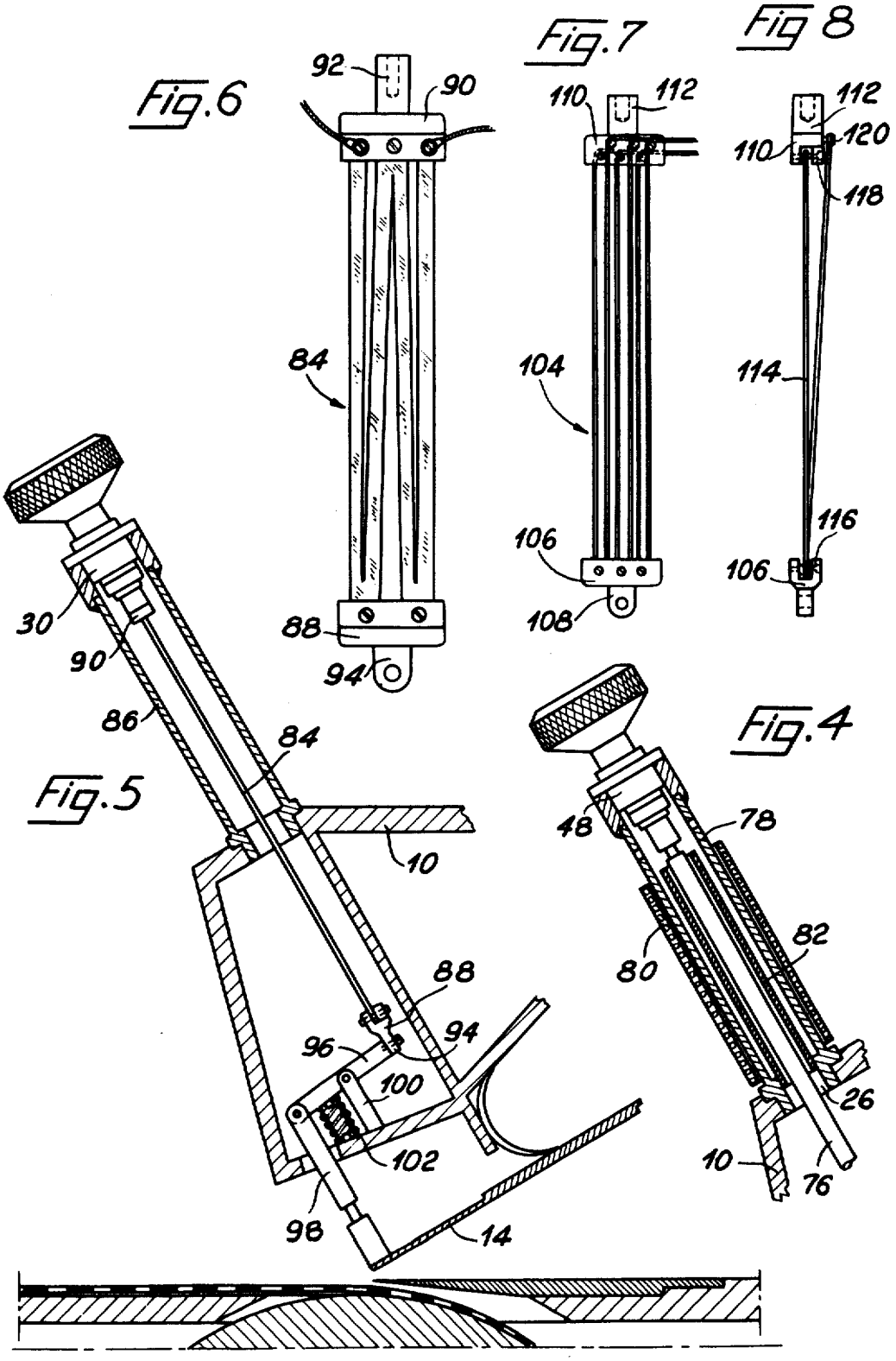
FIG. 4 is a diagrammatic section similar to part of FIG. 3 and illustrating a different form of the positioning means in accordance with the invention.
FIG. 5 is a diagrammatic section similar to FIG. 1 and illustrates a modified form of the positioning means in accordance with the invention.
FIG. 6 is a plan view of the positioning member of the apparatus shown in FIG. 5.
FIGS. 7 and 8 show, in front elevation and side elevation respectively, a modified form of the positioning member intended for use in the FIG. 5 arrangement.

FIG. 4 illustrates a further modified form of the equipment in accordance with the invention for effecting differential positioning. This differential adjustment is shown in its application to the FIG. 3 construction, but it should be pointed out that it can also be applied in a general way to all the other forms of construction.

More precisely, as indicated in FIG. 4, the rod 76, corresponding to the rod 46 in the FIG. 3 arrangement, is mounted on the screw-jack 48 and it passes through the opening 26 in the frame 10. The support tube 50 is replaced by a tube 78 which performs the same function as the tube 50 but which, in addition, advantageously has a relatively great co-efficient of thermal expansion. A heating element 80 in the form of a resistance-heating sleeve surrounds the support tube 78. It is supplied with electric energy from a source, not illustrated, by way of wires, likewise not illustrated. In one advantageous arrangement, a heat-insulating sleeve 82 is held between rod 76 and the support tube 78.

The arrangement shown in FIG. 4 functions in the following manner. When the movable lip is to be brought closer to the production wire, the rod 76 is heated in the manner described by reference to FIGS. 1 to 3. However, if the lip is to be moved rapidly away from the production wire, the thermal inertia of the tube 76 prevents a rapid return. In these conditions, the heating element 80 is then supplied with current and it rapidly heats up the support tube 78. This expands and moves the lip away from the production wire. The insulating sleeve 82 facilitates the thermal uncoupling of the tubes 76 and 78.

This arrangement is considerably more sensitive than those illustrated in FIGS. 1 to 3, since it it known that heating can occur much more rapidly than does natural cooling. This arrangement therefore constitutes an interesting variant which can be used instead of artificial cooling of the tube 76.

FIG. 5 illustrates a modified form of the means shown in FIG. 1. The reference numerals 10, 14 and 30 indicate the same elements as in FIG. 1, namely the frame, regulating lip and the screw-jack respectively.

This form of construction comprises a positioning member 84 of a flexible type, illustrated in greater detail in FIG. 6; this member is placed in a support tube 86, exactly similar to the tube 34 or 50. The positioning member 84 comprises four flexible strips made from a suitable metallic alloy, for example "Kanthal" or Chromium (20%)-Nickel (80°), which is used for producing electrical resistors but which nevertheless has good mechanical strength. The ends of the strips 86 are clamped in two supports 88 and 90. The support 90 has an extension 92 designed to be secured to the screw-jack 30, whereas the support 88 has a tab 94, in which is pierced a hole for affording passage to a screw-threaded rod extending from a lever 96. The latter is hinged on arms 100 secured to the frame and to a control rod 98 for the lip 14. Furthermore, a spring 102 is advantageously fitted between the frame 10 and the lver 96 so that it pushes this lever in the direction that causes the application of a tension force to the positioning member 84.

The advantage associated with the positioning member 84 is that is can be directly heated by the Joule effect and it can therefore be very sensitive to heat. Furthermore, since it is constituted by flat strips which have a small thickness but a large area, it cools down rapidly. The lever 96 constitutes an example of a force-transmission element, but the assembly may instead be as illustrated in FIG. 3, the spring 102 being suitably repositioned. The arm 100 may be arranged at any suitable place so that it provides the required multiplication ratio of, for example, 1.

FIGS. 7 and 8 illustrate a modified form of flexible positioning member, similar to the member 84 shown in FIG. 6. In this variant, the member 104 comprises a first end support 106 provided with a tab 108 similar to the tab 94 associated with the member 84, and a further end support 110 provided with a means 112 for mounting on a screw-jack. The resistance-heating wires 114, which have a high mechanical resistance to tension, pass over insulating sleeves carried by screws 116 extending into the support 106, and over other insulating sleeves carried by screws 118 and 120 positioned on the other support 110. The wires are held on the support 110 in such a way that they are able to transmit tension forces between the two supports 106 and 110. This flexible positioning member 104 may be used instead of the member 84 in the FIG. 5 construction, and it has the same advantages as this latter member.

Figure 9:
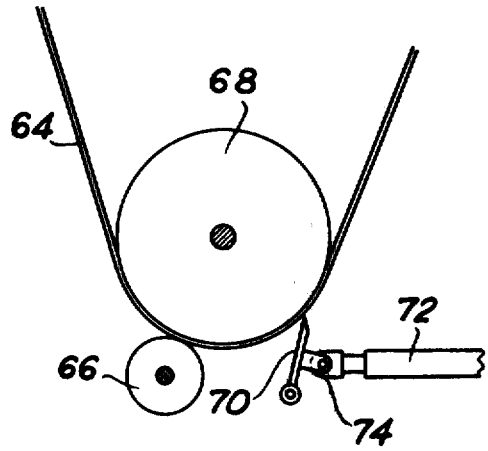
FIG. 9 is a sketch illustrating the use of the invention in the fine adjustment of a blade of a coating machine.

FIG. 9 illustrates a further example of the application of the invention. This Figure is a very simple sketch of a coating machine comprising a blade. A sheet of paper 64 is moved on a cylinder 68, and a coating roller 66 applies a surface layer of an aqueous dispersion containing, for example, mainly particles of kaolin and a suitable adhesive. A blade 70 is pressed against the paper 64 carried by the cylinder 66, and a certain force has to be applied to the blade 70 so as to obtain an even coating. The positioning means are perfectly suitable for this purpose, in view of the range over which they can be adjusted. FIG. 9 illustrates diagrammatically the end of a tube 72 of a positioning means which may be of the same type as those illustrated in FIGS. 1 to 4. A hinge 74 transmits to the blade 70 the force applied by the tube 72.

The invention is not of course limited to the particular forms of construction described above. Thus, although only a horizontal-type paper-making machine has been considered, the invention can be applied just as well in the adjustment of the moving lip in vertical machines. Furthermore, the fine-adjustment means of the invention has been described in a form associated with a coarse-adjustment means constituted by a screw-jack 30 or 48. It should be pointed out that the invention is also suitable for modern head-boxes, wherein each rod is actuated by a motor-reducer unit. In this case, the motor-reducer unit ensures only coarse adjustment, and the heating of the positioning devices in accordance with the invention leads to fine adjustment.

In particular, it should be pointed out that the fine-adjustment means in accordace with the invention are very reliable in view of their substantially stationary nature, and they require no maintenance or lubrication and they are particularly inexpensive. In addition, the technology necessary for carrying out the invention has been known to experts in the field for several dozen years.

While preferred embodiments of the present invention have been described, it should be understood that the invention is not limited thereto and is determined solely by the scope of the appended claims.

We claim:

1. Apparatus for adjusting the position of one of a pair of slice lips of a paper machine head-box with respect to the other, said one lip being an inclined scraper blade pivotally connected to said head-box, said adjusting being by displacing said blade in a pre-determined direction, said apparatus comprising a frame portion of said head box; positioning means connected to said frame portion and said scraper blade, said positioning means including a heat-expansible part and a support tube surrounding said heat-expansible part, with a passage being defined between said heat-expansible part and said support tube permitting flow of a fluid therebetween, said support tube having one end mounted on said frame portion and extending away from said frame portion in said pre-determined direction, said heat-expansible part having one end attached to an opposite end of said support tube and having its other end interconnected with said scraper blade; means for heating said heat-expansible part; and means for controlling said means for heating said heat-expansible part in dependence upon the required position of said scraper blade in relation to the other lip.

2. Apparatus according to claim 1, further comprising means for coarsely adjusting the position of of said scraper blade mounted on said opposite end of said support tube and interconnecting said heat-expansible part to said support tube.

3. Apparatus according to claim 1, wherein said means for coarsely adjusting comprises a manually operable screw-jack.

4. Apparatus according to claim 1, further comprising means for cooling said heat-expansible part by passage of a cooling fluid therearound inside of said support tube.

5. Apparatus according to claim 1, further comprising means for heating said support tube to expand said support tube in said pre-determined direction.

6. Apparatus according to claim 5, further comprising thermal insulation means between said support tube and said heat-expansible part.

7. Apparatus for adjusting the position of one of a pair of slice lips of a paper machine head box with respect to the other, said one lip being an inclined scraper blade pivotally connected to said head box, said adjusting being by displacing said blade in a pre-determined direction, said apparatus comprising a frame portion of said head box; positioning means connected at one point to said frame portion and at a second point to said scraper blade, said positioning means including a mounting part including a support tube having two ends with one end fixed to said frame portion, a lever pivotally mounted on said frame portion with said scraper blade being connected to a first portion of said lever, and a heat-expansible part surrounded by said support tube and having opposite ends with one end connected to the other end of said support tube and the opposite end being connected to a second portion of said lever, said support tube and said heat-expansible part having defined therebetween a passage permitting flow of a fluid therebetween; means for heating said heat-expansible part; and means for controlling said means for heating said heat-expansible part in dependence upon the required position of said scraper blade in relation to the other lip.

8. Apparatus according to claim 7, wherein said lever has two ends and a middle section, said first portion is one of said ends, said second portion is said middle section, and the lever is pivotally mounted at its other end.

9. Apparatus according to claim 8 wherein said heat-expansible part is flexible and thin, and said positioning means further includes means for resiliently biasing said lever to maintain tension on said heat-expansible part.

10. Apparatus according to claim 1 wherein said heat-expansible part is flexible and thin, and said positioning means further includes means for resiliently biasing said lever to maintain tension on said heat-expansible part.

11. Apparatus according to claim 7, wherein said lever has two ends and a middle section, said first portion is one end, said second portion is the other end, and the lever is pivotally mounted at its middle section.

12. Apparatus according to claim 8, wherein said middle section has a center and said heat-expansible part is connected to said middle section at a position other than said center.

13. Apparatus according to claim 11, wherein said middle section has a center and said lever is pivoted at a position other than said center.

* * * * *